US009441390B2

(12) United States Patent
Ijichi

(10) Patent No.: US 9,441,390 B2
(45) Date of Patent: Sep. 13, 2016

(54) STORAGE TANK CONSTRUCTION METHOD

(71) Applicant: IHI Corporation, Tokyo (JP)

(72) Inventor: Saori Ijichi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 14/820,299

(22) Filed: Aug. 6, 2015

(65) Prior Publication Data

US 2015/0345167 A1 Dec. 3, 2015

Related U.S. Application Data

(63) Continuation of application No. PCT/JP2014/063299, filed on May 20, 2014.

(30) Foreign Application Priority Data

May 20, 2013 (JP) ..... 2013-106465

(51) Int. Cl.

| | |
|---|---|
| ***E04G 21/00*** | (2006.01) |
| ***E04H 7/20*** | (2006.01) |
| ***E04B 1/16*** | (2006.01) |
| ***E04B 2/86*** | (2006.01) |
| ***E04H 7/18*** | (2006.01) |
| *E04H 7/06* | (2006.01) |

(52) U.S. Cl.

CPC ..... *E04H 7/20* (2013.01); *E04B 1/167* (2013.01); *E04B 2/8635* (2013.01); *E04H 7/18* (2013.01); *E04B 2103/02* (2013.01); *E04H 7/06* (2013.01)

(58) Field of Classification Search

CPC ..... E04H 7/18; E04B 1/167; E04B 1/3505; E04B 2/8635; E04B 2103/02; E04G 15/00; E04G 15/061

See application file for complete search history.

(56) References Cited

U.S. PATENT DOCUMENTS 4,865,781 A * 9/1989 Jennings ..... E04B 2/04 256/19

FOREIGN PATENT DOCUMENTS

| | | | |
|---|---|---|---|
| JP | 59-210164 | A | 11/1984 |
| JP | 10-104384 | A | 4/1998 |
| JP | 10-237993 | A | 9/1998 |
| JP | 2003-314078 | A | 11/2003 |
| JP | 2013-32170 | A | 2/2013 |

OTHER PUBLICATIONS

International Search Report mailed Aug. 5, 2014 in PCT/JP2014/063299 (4 pages).

* cited by examiner

*Primary Examiner* — Patrick Maestri

(74) *Attorney, Agent, or Firm* — Rothwell, Figg, Ernst & Manbeck, P.C.

(57) ABSTRACT

The storage tank construction method includes a step of forming a side wall while a temporary opening is provided, a step of fitting precast concrete slabs into respective inner and outer wall sides of the temporary opening to close the inner and outer wall sides of the temporary opening, and a step of pouring concrete between the precast concrete slabs using the precast concrete slabs as molds to block the temporary opening.

4 Claims, 5 Drawing Sheets

STORAGE TANK CONSTRUCTION METHOD

CROSS REFERENCE TO RELATED APPLICATIONS

This application is a continuation application based on a PCT Patent Application No. PCT/JP2014/063299, filed May 20, 2014, whose priority is claimed on Japanese Patent Application No. 2013-106465, filed on May 20, 2013. The contents of both the PCT Application and the Japanese Application are incorporated herein by reference.

TECHNICAL FIELD

Embodiments described herein relate to a storage tank construction method.

BACKGROUND ART

For conventional ground-type storage tank construction, when a side wall is formed, a temporary opening for carrying in construction materials through the side wall is formed. This temporary opening is blocked by cast-in-place concrete when the ground-type storage tank construction is completed. To be specific, molds are assembled with respect to the temporary opening on inner and outer sides of the side wall, and then concrete is poured between the molds. Thereby, the temporary opening is blocked.

After the side wall is formed, when a roof is raised on the side wall, for example, using an air-raising method, the temporary opening may be temporarily blocked. In this case, a blocking plate is temporarily welded and fixed to a frame-shaped temporary member that is previously embedded around the temporary opening, or a blocking plate is attached using reinforcing bars protruding into the temporary opening (see Patent Document 1).

CITATION LIST

Patent Documents

Patent Document 1: Japanese Unexamined Patent Application, First Publication No. 2003-314078

SUMMARY

Technical Problem

However, in blocking the temporary opening when the tank construction is completed, as described above, the molds are assembled, and then the cast-in-place concrete is poured between the molds. Accordingly, labor is required in a process of blocking the temporary opening, and this process prevents the shortening of a construction period. That is, since work is required, such as installing the molds for blocking the temporary opening and removing the molds after the blockage of the temporary opening is completed, a great deal of time is required for this work. For example, when the molds are removed, the mold disposed on the inner side of the side wall needs to be carried out to the outside over the side wall. Thus, a long time is required for the work since, for example, a crane is required.

Since the cast-in-place concrete for blocking the temporary opening is poured between the molds, accuracy control for forming a blocking portion of may be difficult.

The present disclosure has been made in view of the above circumstances, and an object thereof is to provide a storage tank construction method capable of facilitating a process of blocking a temporary opening to shorten a construction period, and further facilitating accuracy control to improve accuracy.

Solution to Problem

A first aspect of the present disclosure provides a storage tank construction method including: a step of forming a side wall while a temporary opening is provided; a step of fitting precast concrete slabs into respective inner and outer wall sides of the temporary opening to close the inner and outer wall sides of the temporary opening; and a step of pouring concrete between the precast concrete slabs using the precast concrete slabs as molds to block the temporary opening.

Also, according to a second aspect of the present disclosure, in the storage tank construction method according to the first aspect, metal plates are previously bonded to inside surfaces of the precast concrete slabs.

In addition, according to a third aspect of the present disclosure, in the storage tank construction method according to the first or second aspect, after the precast concrete slabs are fitted into the respective inner and outer wall sides of the temporary opening, a separator is mounted between the precast concrete slabs to maintain an interval between the precast concrete slabs constant, and then the concrete is poured between the precast concrete slabs.

Advantageous Effects

According to the storage tank construction method of the present disclosure, concrete is poured between the precast concrete slabs using the precast concrete slabs as molds to block the temporary opening. Therefore, work such as installation and removal of molds as in the related art are not required, and the time required for this work is eliminated. As a result, a construction period can be significantly reduced compared to that of the related art.

Also, the precast concrete slabs are fitted into the respective inner and outer wall sides of the temporary opening to close the respective inner and outer wall sides of the temporary opening. Afterward, concrete is poured between the precast concrete slabs, and blocks the temporary opening. Therefore, in comparison with the related art in which the entire interior of the temporary opening is formed by the cast-in-place concrete, control over precision is easy, and a blocked portion of the temporary opening can be improved in precision.

DESCRIPTION OF EMBODIMENTS

Hereinafter, a storage tank construction method of the present disclosure will be described in detail with reference to the drawings. In the following drawings, the scale of each member is suitably changed so as to be recognizable.

First, an example of a storage tank obtained by the construction method of the present disclosure will be described with reference to FIGS. 1A and 1B. Reference sign 1 in FIG. 1A denotes a ground-type low-temperature tank (hereinafter referred to as "low-temperature tank") acting as the storage tank according to the present disclosure.

Figure 1A:
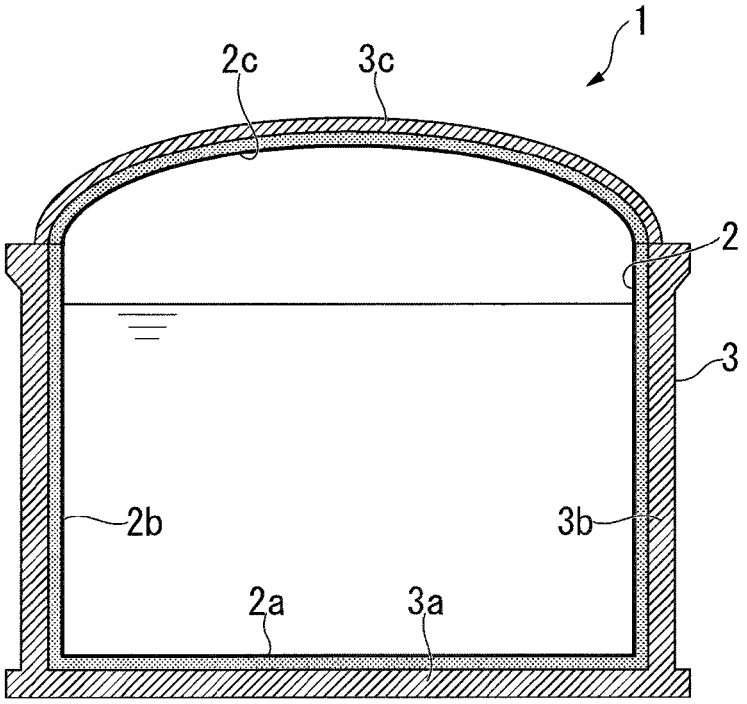
FIG. 1A is a view illustrating an example of a storage tank according to the present disclosure, and is a side sectional view of the storage tank.

As illustrated in FIG. 1A, the low-temperature tank 1 is intended to store a low-temperature liquefied gas such as liquefied natural gas (LNG), and is equipped with an inner tank 2 formed of a metal and an outer tank 3 formed of concrete. The inner tank 2 is a metal container that directly stores the liquefied gas, and is equipped with a bottom 2*a*, a side wall 2*b*, and a roof 2*c*.

The outer tank 3 is a concrete container with which the inner tank 2 is enclosed. As illustrated in FIGS. 1A and 1B, the outer tank 3 is equipped with a bottom 3*a*, a side wall 3*b*, and a roof 3*c*.

Although not illustrated, a gap is formed between the inner tank 2 and the outer tank 3, and a cold insulator or a liner is accommodated in the gap.

Figure 1B:
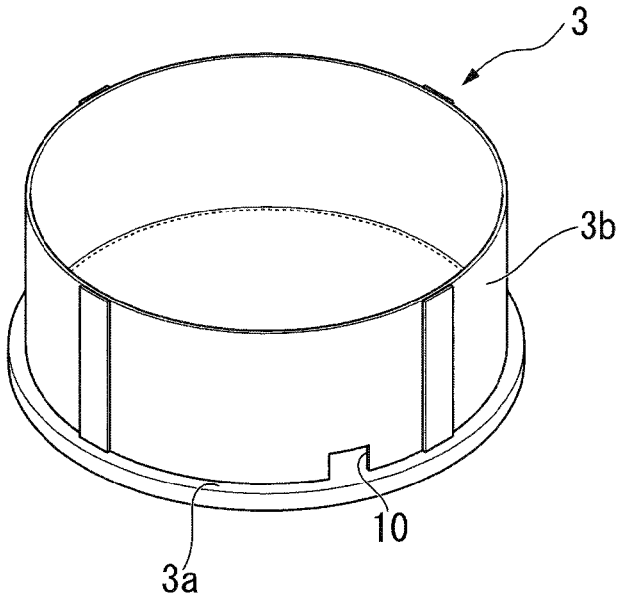
FIG. 1B is a perspective view of a side wall of an outer tank in the storage tank according to the present disclosure.

When the low-temperature tank 1 having this constitution is constructed, and particularly when the outer tank 3 formed of concrete is constructed, first, the bottom 3*a* of the outer tank 3 is formed as illustrated in FIG. 1B, and the side wall 3*b* is further formed on the bottom 3*a*. When the side wall 3*b* is formed, a temporary opening 10 is formed in nearly the same way as in the related art. The temporary opening 10 is a rectangular opening having a predetermined size, for example, a width of about 5,000 mm and a height of about 3,000 mm, and is formed such that the temporary opening 10 at a lower end of the side wall 3*b* abuts on the top of the bottom 3*a*. That is, the temporary opening 10 is an opening formed between the side wall 3*b* and the bottom 3*a* in a rectangular shape by partly cutting the lower end of the side wall 3*b*.

However, a rectangular opening may be directly formed in the lower end of the side wall 3*b*, and be used as the temporary opening 10.

The number of temporary openings 10 typically formed in one low-temperature tank 1 is two, but it may be one, or three or more.

Figure 2A:
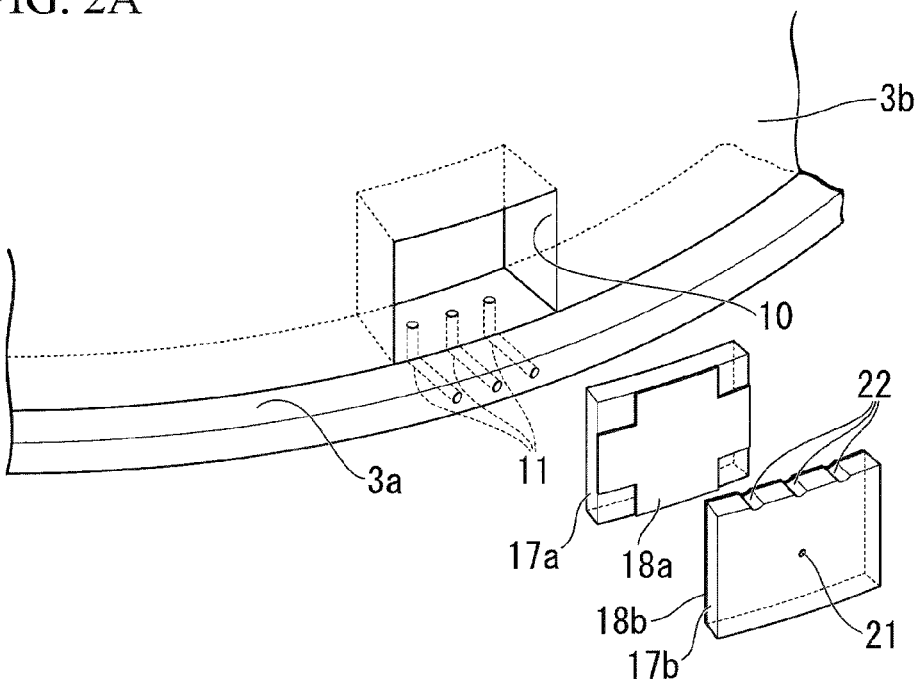
FIG. 2A is a perspective view illustrating a circumferential edge of a temporary opening for describing steps of a construction method of the present disclosure.
Figure 2B:
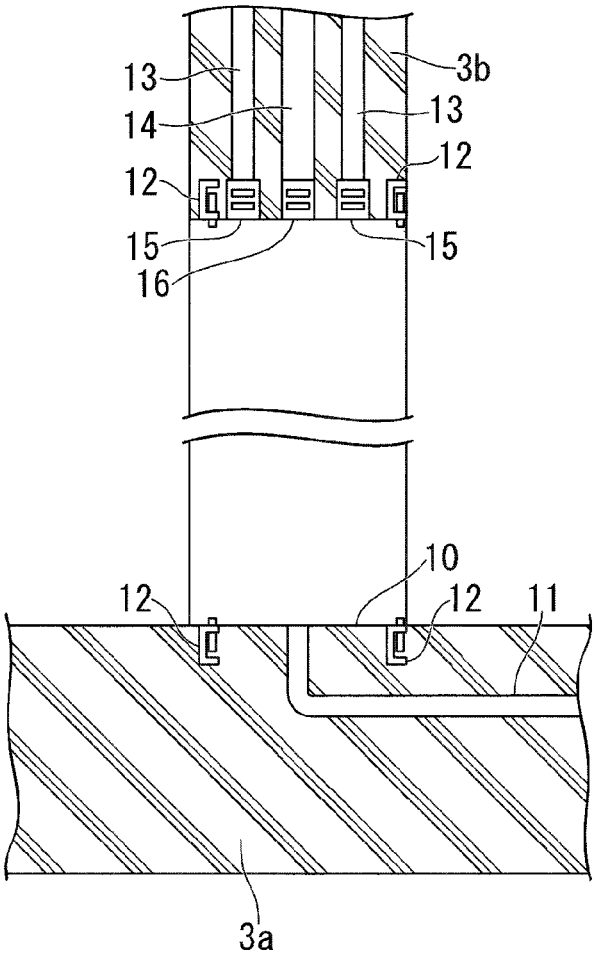
FIG. 2B is a side sectional view illustrating the circumferential edge of the temporary opening for describing the steps of the construction method of the present disclosure.

In the present embodiment, as illustrated in FIGS. 2A and 2B, when the bottom 3*a* is formed, L-shaped pipes 11 are embedded in a portion of the bottom 3*a* directly beneath the temporary opening 10. Each pipe 11 is disposed such that an opening of one end side thereof faces an outer circumferential surface of the bottom 3*a* and that an opening of the other end side thereof faces the top of the bottom 3*a*, that is, the interior of the temporary opening 10. Here, the opening of the other end side of each pipe 11 is, as illustrated in FIG. 2B, disposed in a nearly central portion of the temporary opening 10 in a thickness direction (direction passing through the temporary opening). The number of pipes 11 is not particularly restricted. However, in the present embodiment, as illustrated in FIG. 2A, three pipes 11 are embedded at regular intervals in a circumferential direction of the side wall 3*b*. However, the number of pipes 11 may be either two or less, or four or more.

Also, as illustrated in FIG. 2B, connecting fittings 12 are embedded in the portion of the bottom 3*a* directly beneath the temporary opening 10. The connecting fittings 12 are embedded in the vicinity of an inside opening of the temporary opening 10 (i.e. an inner wall side opening of the side wall 3*b*) and in the vicinity of an outside opening of the temporary opening 10 (i.e. an outer wall side opening of the side wall 3*b*). In addition, the connecting fittings 12 are embedded at least at both sides of the temporary opening 10 in a rightward/leftward direction (horizontal direction) when viewed from the front.

Each of the connecting fittings 12 is made up of, for example, an angle bar in which holes are formed and bolts inserted into the holes of the angle bar. The bolts are mounted on the angle bar to be retractable between the interior of the bottom 3*a* and the interior of the temporary opening 10. When the bolts of the connecting fittings 12 are connected to connecting fittings 19 (angle bars) embedded in precast concrete slabs 17*a* and 17*b* to be described below, and are fastened by, for example, nuts, the angle bars of the connecting fittings 12 and the angle bars of the connecting fittings 19 can be connected and fixed to each other.

The connecting fittings 12 are also embedded at a position of the side wall 3*b* which faces the interior of the temporary opening 10, that is, at the lower end of the side wall 3*b*. Similar to the connecting fittings 12 embedded in the bottom 3*a*, the connecting fittings 12 are embedded in the vicinity of the inside opening of the temporary opening 10 (i.e. the inner wall side opening of the side wall 3*b*) and in the vicinity of the outside opening of the temporary opening 10 (i.e. the outer wall side opening of the side wall 3*b*). In addition, the connecting fittings 12 are embedded at least at both sides of the temporary opening 10 in the rightward/leftward direction (horizontal direction) when viewed from the front. By embedding the connecting fittings 12 in the bottom 3*a* and the side wall 3*b* in this way, rectangular precast concrete slabs to be described below can be easily fixed to the inner and outer wall side openings of the temporary opening 10, respectively.

Also, as in the related art, reinforcing bars 13 and a sheath 14 for prestress introduction are embedded in the side wall 3*b*. As will be described below, couplers 15 for connecting new reinforcing bars to the reinforcing bars 13 are mounted at positions of the reinforcing bars 13 which face the interior of the temporary opening 10, that is, at positions that are exposed to an inner circumferential surface (upper and lateral surfaces) of the temporary opening 10. Similarly, a coupler 16 for connecting a new sheath to the sheath 14 is mounted to the sheath 14. As the couplers 15 and the coupler 16, conventionally known couplers such as types screwed with, for example, screws are used.

Although not illustrated in FIG. 2B, couplers 15 and a coupler 16 for connecting reinforcing bars and a sheath may also be provided for reinforcing bars and a sheath embedded in the bottom 3*a* at positions that are exposed to the inner circumferential surface of the temporary opening 10.

Figure 3:
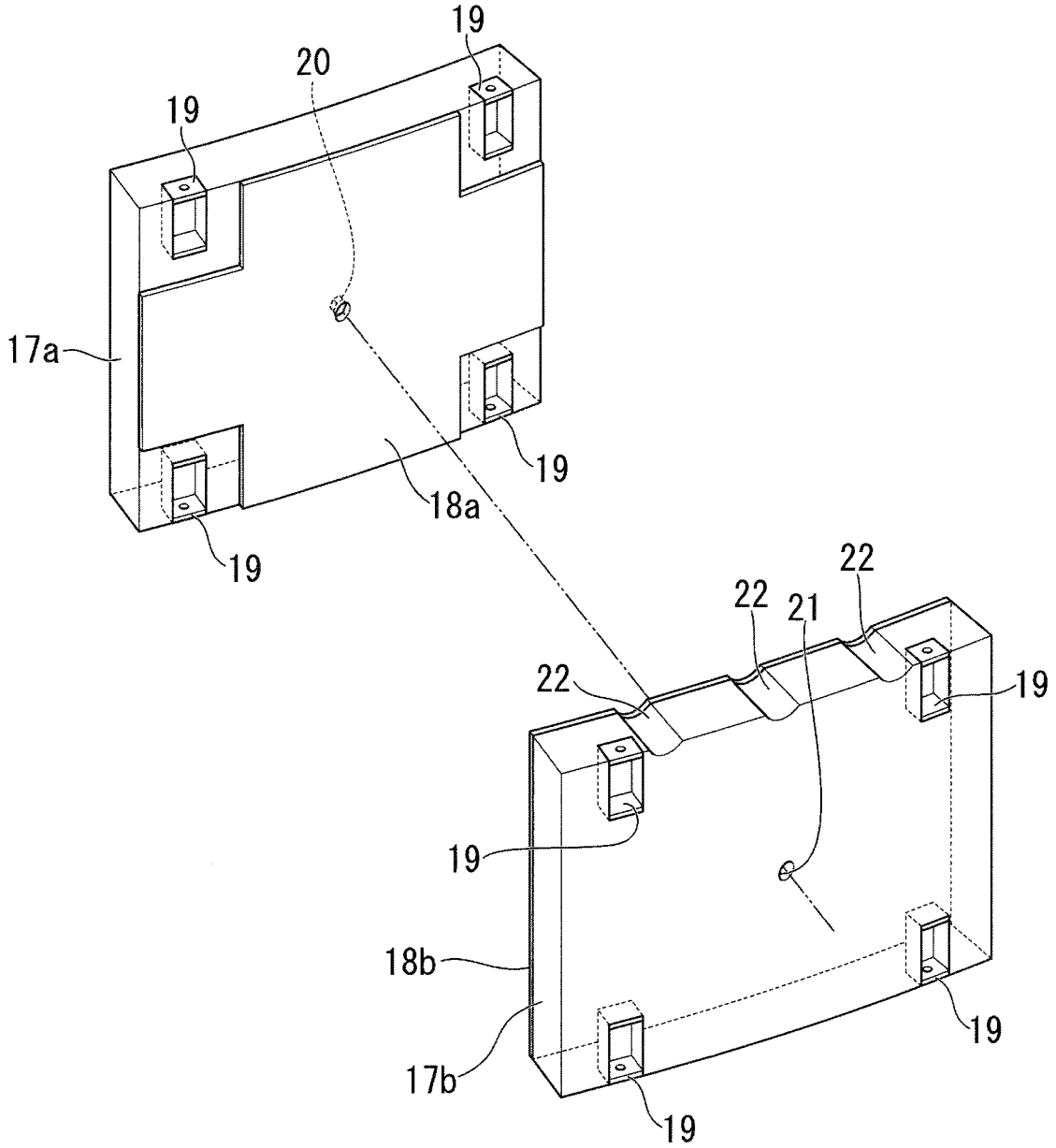
FIG. 3 is a perspective view illustrating schematic constitutions of precast concrete slabs.

After the bottom 3*a* and the side wall 3*b* are formed with the temporary opening 10 provided in this way, the precast concrete slabs 17*a* and 17*b* having a thickness of about 80 mm are fitted into the inner and outer wall sides of the temporary opening 10 respectively. As illustrated in FIG. 3, the precast concrete slabs 17*a* and 17*b* are previously manufactured to suit the shape and dimensions of the temporary opening 10 at a workshop or the like, and are transported to a construction site by a vehicle or the like and are used there.

A rectangular metal plate 18*a* that is formed of iron or the like and has a thickness of about 10 mm is previously bonded to nearly the entirety of an inside surface of the precast concrete slab 17*a* disposed at the inner wall side of the temporary opening 10, that is, a surface opposite a surface that becomes the inner circumferential surface of the side wall 3*b*, at a workshop. However, a shape of the metal plate 18*a* has a shape that avoids positions at which the connecting fittings 19 and a nut 20 to be described below are embedded in the precast concrete slab 17*a* so as to be able to expose the connecting fittings 19 and the nut 20. For example, the metal plate 18*a* is formed in a shape in which angled portions (four corner portions) in a rectangular shape are cut out and a through-hole is further formed in the center thereof. In FIG. 3, a structure in which the connecting fittings 19 are embedded only in the four corners is illustrated. However, the connecting fittings 19 may also be embedded in positions other than these. In that case, the shape of the metal plate 18*a* is also changed to expose all the connecting fittings 19.

A through-hole 21 for inserting a separator 25 (to be described below) is formed in the center of the precast concrete slab 17*b* disposed at the outer wall side of the temporary opening 10. A rectangular metal plate 18*b* formed of iron or the like is previously bonded to nearly the entirety of an inside surface of the precast concrete slab 17*b*, that is, a surface opposite a surface that becomes the outer circumferential surface of the side wall 3*b*, at a workshop. Cutout grooves 22 are formed in an upper end of the precast concrete slab 17*b*. The cutout grooves 22 are cut and formed from the front to the back of the precast concrete slab 17*b*. The cutout grooves 22 are not particularly limited in number and size, and are of a suitable number and size. In the present embodiment, three cutout grooves 22 are formed corresponding to the number of pipes 11.

Here, unlike the precast concrete slab 17*a*, the precast concrete slab 17*b* is configured such that the metal plate 18*b* is bonded to a surface opposite a surface to which the connecting fittings 19 are exposed. Accordingly, no corner portions of the metal plate 18*b* are cut out. However, a position corresponding to the through-hole 21 and positions corresponding to the cutout grooves 22 need to be cut in the metal plate 18*b*. Therefore, a through-hole is formed in the center of the metal plate 18*b*, and cutout portions communicating with the cutout grooves 22 are formed in the upper end of the metal plate 18*b*.

As described above, the connecting fittings 19 are previously embedded in the corner portions of the precast concrete slabs 17*a* and 17*b*. The connecting fittings 19 are disposed at both sides of each of lower and upper ends of the precast concrete slabs 17*a* and 17*b*, these sides becoming positions opposite the connecting fittings 12 embedded in the bottom 3*a* and side walls 3*b* in the upward/downward direction. Similar to the connecting fittings 12, the connecting fittings 19 are formed by angle bars with holes.

In the precast concrete slab 17*a* of the inner wall side, the connecting fittings 19 are embedded in the precast concrete slab 17*a* so that the connecting fittings 19 are exposed to an inside surface of the precast concrete slab 17*a*, that is, a surface facing the outside of the side wall 3*b*. On the other hand, in the precast concrete slab 17*b* of the outer wall side, the connecting fittings 19 are embedded in the precast concrete slab 17*b* so that the connecting fittings 19 are exposed to an outside surface of the precast concrete slab 17*b*, that is, a surface facing the outside of the side wall 3*b*. With this constitution, connecting work of the precast concrete slabs 17*a* and 17*b* can be easily performed from the outside of the side wall 3*b*.

A nut 20 screwed to one end side of the separator 25 (to be described below) is embedded in the center of the inside surface of the precast concrete slab 17*a* such that one surface of the nut 20 is exposed to the inside surface of the precast concrete slab 17*a* and communicates with the through-hole of the bonded metal plate 18*a* bonded to the precast concrete slab 17*a*.

Figure 4A:
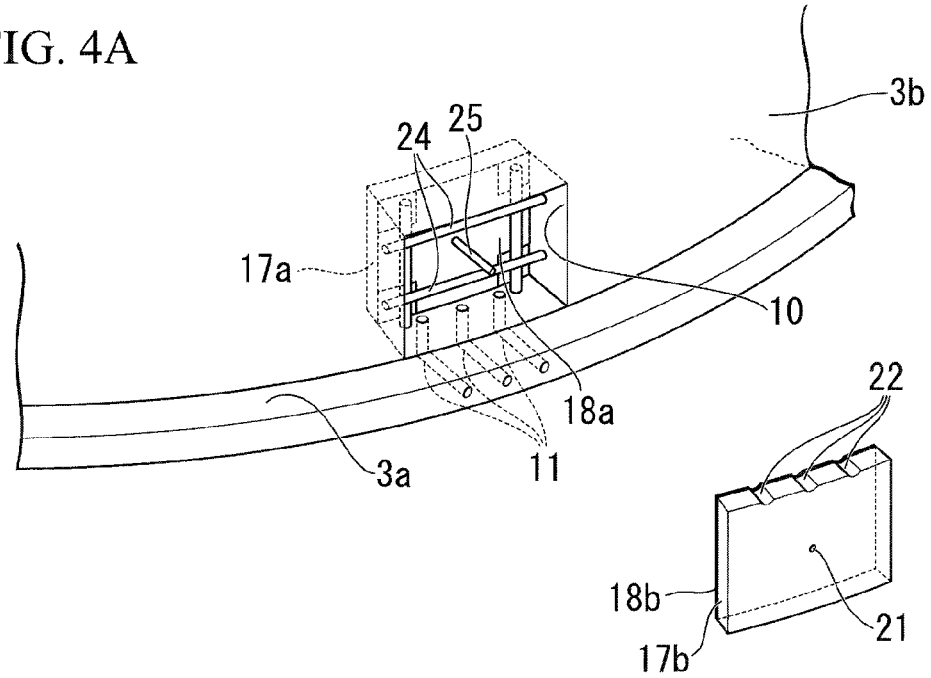
FIG. 4A is a perspective view illustrating the circumferential edge of the temporary opening for describing the steps of the construction method of the present disclosure.
Figure 4B:
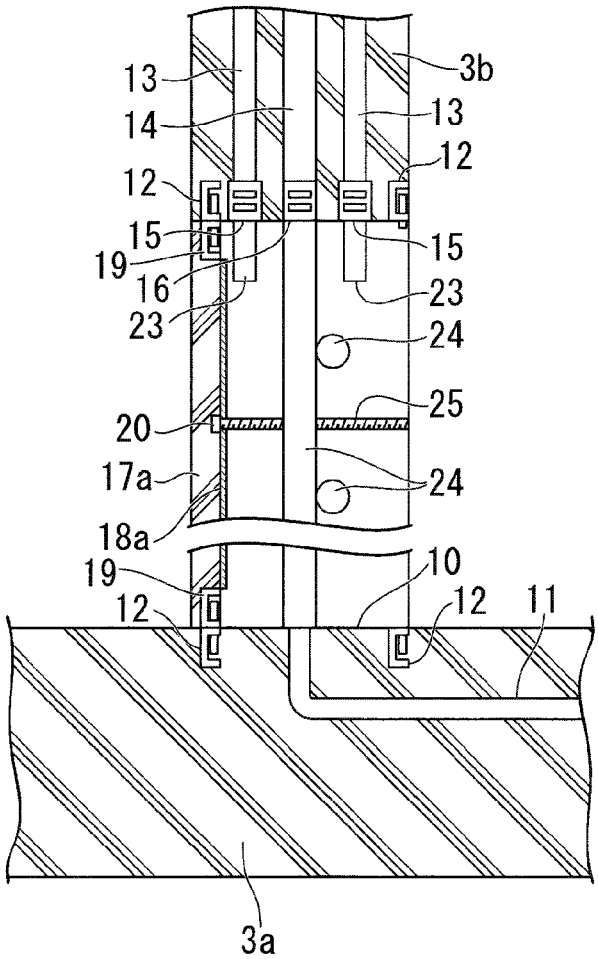
FIG. 4B is a side sectional view illustrating the circumferential edge of the temporary opening for describing the steps of the construction method of the present disclosure.

Of the precast concrete slabs 17*a* and 17*b*, first, the precast concrete slab 17*a* of the inner wall side is fitted to the inner wall side in the temporary opening 10, as illustrated in FIG. 4A. Then, as illustrated in FIG. 4B, the connecting fittings 19 embedded in the precast concrete slab 17*a* are connected to the connecting fittings 12 that are opposite each other in the upward/downward direction. That is, the connecting fittings 19 embedded in the upper end portion of the precast concrete slab 17*a* are connected to the connecting fittings 12 embedded in the side wall 3*b*, and the connecting fittings 19 embedded in the lower end portion of the precast concrete slab 17*a* are connected to the connecting fittings 12 embedded in the bottom 3*a*. The connection between the connecting fittings 12 and 19 is performed by fitting tip sides of the bolts provided at the connecting fittings 12 into the holes of the connecting fittings 19 and screwing the nuts.

After all the connecting fittings 12 and 19 are connected in this way, reinforcing bars 23 are connected to the couplers 15 of the reinforcing bars 13 that are exposed to the inner circumferential surface (upper and lateral surfaces) of the temporary opening 10, that is, the surface of the side wall 3*b* which is at the side of the temporary opening 10. The reinforcing bars 23 are intended to integrate the side wall 3*b* and the concrete blocking the temporary opening 10 and to strengthen them. In the present embodiment, since the strength of the concrete itself blocking the temporary opening 10 is reinforced by the metal plates 18*a* and 18*b*, the reinforcing bars 23 are disposed primarily with the intention of integrating the side wall 3*b* and the concrete blocking the temporary opening 10. For this reason, the reinforcing bars 23 need not be continuously disposed in the temporary opening 10 from top to bottom or from right to left, and need only be disposed to extend into a circumferential edge of the temporary opening 10. Accordingly, the reinforcing bars 23 have a length of several tens of centimeters. The reinforcing bars 23 are connected to the couplers 15 and disposed.

In FIG. 4B, the reinforcing bars 23 extend from the lower end of the side wall 3*b* into the temporary opening 10. However, the reinforcing bars 23 may also extend from the lateral surfaces of the side wall 3*b* which face the interior of the temporary opening 10 into the temporary opening 10.

If the couplers 15 are embedded in the bottom 3*a*, the reinforcing bars 23 also extend from the bottom 3*a* into the temporary opening 10.

In addition, apart from the reinforcing bars 23, a new sheath 24 is connected to the sheath 14. That is, the sheath 24 is connected to the sheath 14 of the side wall 3*b* by the coupler 16 so as to communicate with the sheath 14. Thereby, after the temporary opening 10 is blocked by the concrete, a tensional force is applied to the sheaths 14 and 24 through a prestressed concrete (PC) wire, and grout is further injected into remaining spaces in the sheaths 14 and 24 so as to form one body. Thereby, the prestressed concrete can be completed. A new sheath 24 may also be connected to a sheath (not shown) embedded in the bottom 3*a*. Also, the sheath 24 may be disposed in the upward/downward direction (vertical direction) as well as in the leftward/rightward direction (horizontal direction).

After the connection and disposition of the reinforcing bars 23 and the connection and disposition of the sheath 24 are performed in this way, the one end side of the separator 25 formed of an iron rod is mounted on the nut 20 embedded in the center of the precast concrete slab 17*a*. Both ends of the separator 25 are formed with male threads. A length of the separator 25 is slightly shorter than a thickness of the side wall 3*b*. Due to the separator 25 having this constitution, an interval between the precast concrete slab 17*a* and the precast concrete slab 17*b* can be constantly maintained, as will be described below. That is, the separator 25 maintains a fixed interval between the precast concrete slabs 17*a* and 17*b* in a state in which the outside surface of the precast concrete slab 17*a* is flush with the inner wall surface of the side wall 3*b* and the outside surface of the precast concrete slab 17*b* is flush with the outer wall surface of the side wall 3*b*.

Figure 5A:
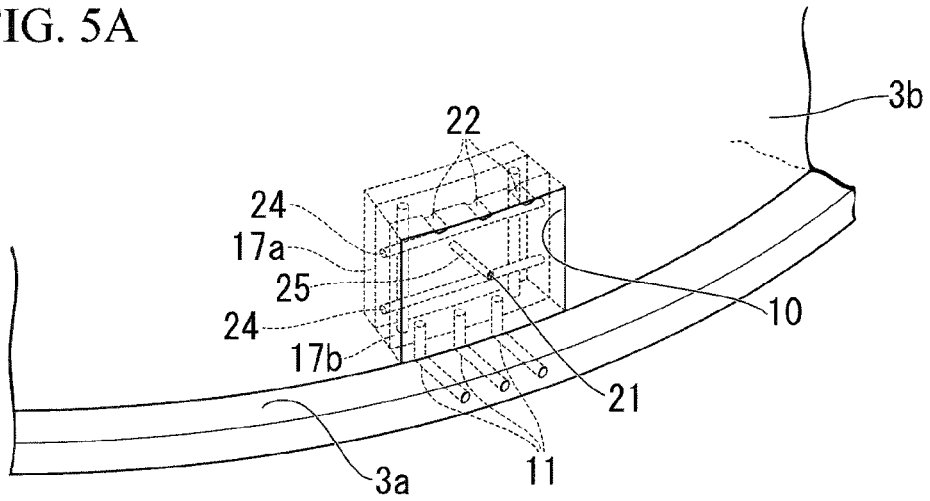
FIG. 5A is a perspective view illustrating the circumferential edge of the temporary opening for describing the steps of the construction method of the present disclosure.
Figure 5B:
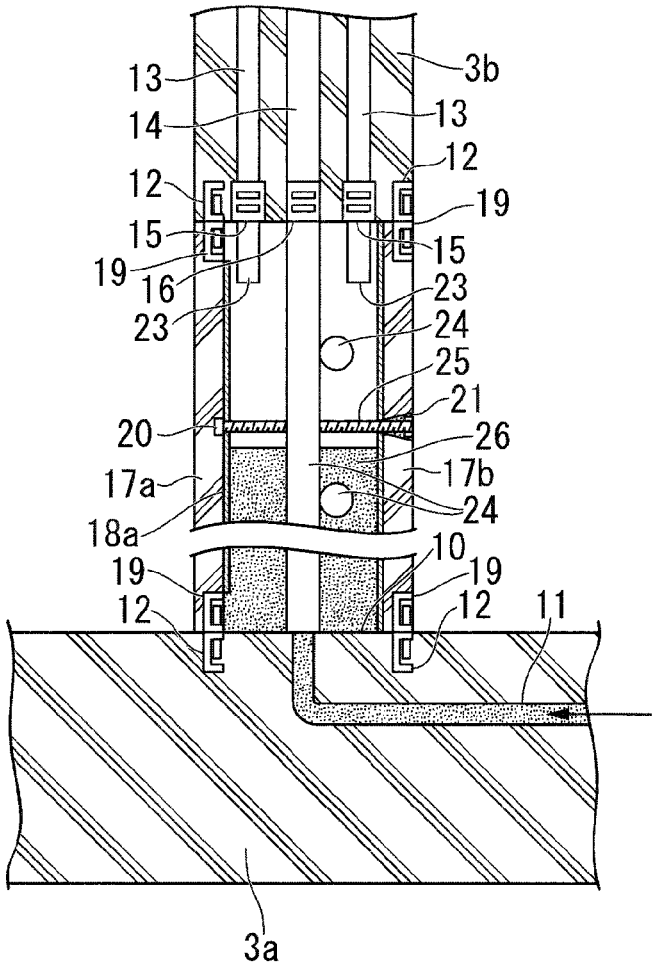
FIG. 5B is a side sectional view illustrating the circumferential edge of the temporary opening for describing the steps of the construction method of the present disclosure.

After the separator 25 is mounted, the precast concrete slab 17*b* of the outer wall side is fitted into the outer wall side in the temporary opening 10 as illustrated in FIG. 5A. At this time, as illustrated in FIG. 5B, the other end of the separator 25 is inserted into the through-hole 21 of the precast concrete slab 17*b*. Then, similar to the case of the precast concrete slab 17*a*, the connecting fittings 19 embedded in the precast concrete slab 17*b* are connected to the connecting fittings 12 that are opposite each other in the upward/downward direction, respectively.

Next, a nut is screwed to the other end of the separator 25 inserted into the through-hole 21, and in this state, mortar is filled and cured in the through-hole 21.

In this way, the precast concrete slab 17*a* and the precast concrete slab 17*b* are fitted into the inner wall side of the temporary opening 10 and the outer wall side of the temporary opening 10 respectively, and are fixed to the side wall 3*b* and the bottom 3*a* via the connecting fittings 12 and 19. Thereby, the precast concrete slabs 17*a* and 17*b* can close the inner and outer wall sides of the temporary opening 10, respectively.

Next, as illustrated in FIG. 5B, ready-mixed concrete 26 is poured between the precast concrete slabs 17*a* and 17*b* using the precast concrete slabs 17*a* and 17*b* as the molds. That is, the ready-mixed concrete 26 is fed from the opening, which faces the outer circumferential surface of the bottom 3*a*, of the one end side of each pipe 11 embedded in the bottom 3*a* under pressure. As a result, since the openings of the inner and outer wall sides in the temporary opening 10 are closed by the respective precast concrete slabs 17*a* and 17*b*, the ready-mixed concrete 26 is filled in the temporary opening 10 from the bottom toward the top.

When the interior of the temporary opening 10 is filled with the ready-mixed concrete, the ready-mixed concrete 26 overflows from the cutout grooves 22 formed in the upper end of the precast concrete slab 17*b* of the outer wall side illustrated in FIG. 5A. After the ready-mixed concrete 26 overflowing from the cutout grooves 22 is checked in this way, the ready-mixed concrete 26 is stopped from being fed under pressure, and the opening of the one end side of each pipe 11 is covered with a cover.

Thereby, the pouring of the ready-mixed concrete 26 between the precast concrete slabs 17*a* and 17*b* in the temporary opening 10 is completed, and the interior of the temporary opening 10 can be filled with the ready-mixed concrete 26.

A slight gap is formed between the precast concrete slabs 17*a* and 17*b* and the bottom 3*a* or the side wall 3*b*, that is, in a joint portion between them. With the pouring (feeding) of the ready-mixed concrete 26 under pressure, a small amount of the ready-mixed concrete 26 leaks out of this joint portion. However, unlike a liquid, the ready-mixed concrete 26 shows low fluidity, and furthermore, is cured over time. Thus, the ready-mixed concrete 26 which has leaked blocks a gap of the joint portion, and in this state, is cured. Therefore, the gap of the joint portion is embedded and blocked, without particularly performing a joint treatment.

After the temporary opening 10 is blocked by the precast concrete slabs 17*a* and 17*b* and the concrete poured between them in this way, the PC wire is inserted into the sheaths 14 and 24 so as to provide a tensile force as in the related art. Then, the grout is injected into the remaining spaces in the sheaths 14 and 24 so as to form one body. Thereby, the concrete blocking the side wall 3*b* and the temporary opening 10 becomes prestressed concrete.

Afterwards, as in the related art, the roof 3*c* is formed, and the low-temperature tank 1 illustrated in FIGS. 1A and 1B is completed.

In the construction method of this low-temperature tank 1, the ready-mixed concrete 26 is poured (fed under pressure) between the precast concrete slabs 17*a* and 17*b* using the precast concrete slabs 17*a* and 17*b* as the molds, and blocks the temporary opening 10. Thus, work such as installation and removal of the molds as in the related art is not required. Accordingly, as time required for this work is eliminated, the construction period can be significantly reduced compared to the related art. Especially, since the work in the interior of the low-temperature tank 1, such as the removal of the mold disposed at the inner wall side of the side wall 3*b*, is not required, work such as delivering the mold over the side wall 3*b* is not required. Accordingly, the work can be safely done in a short time.

Also, the temporary opening 10 is closed by fitting the precast concrete slabs 17*a* and 17*b* into the temporary opening 10, and then is blocked by pouring the concrete between the precast concrete slabs 17*a* and 17*b*. Thus, in comparison with the case in which the entire interior of the temporary opening 10 is formed by the cast-in-place concrete, the inner and outer wall sides of the side wall 3*b* can be easily controlled with high precision. Therefore, the blocked portion of the temporary opening 10 can be produced with improved precision.

As the metal plates 18*a* and 18*b* are previously bonded to the inside surfaces of the precast concrete slabs 17*a* and 17*b* respectively, the concrete blocking the temporary opening 10 is reinforced. Therefore, the reinforcing work in the interior of the temporary opening 10 needs only to extend the reinforcing bars 23 into the temporary opening 10 by connecting the reinforcing bars 23 to the couplers 15. Therefore, the work for disposing the reinforcing bars in the temporary opening 10 can be reduced to a minimum, and the construction period can be further reduced.

In addition, after the precast concrete slabs 17*a* and 17*b* are fitted into the inner and outer wall sides of the temporary opening 10 respectively, the separator 25 is mounted between the precast concrete slabs 17*a* and 17*b*. Therefore, in the state in which the interval between the precast concrete slabs 17*a* and 17*b* is kept constant, the concrete can be poured between the precast concrete slabs 17*a* and 17*b*. As a result, the space between the precast concrete slabs 17*a* and 17*b* can be prevented from being widened by the pressure of the poured concrete. Thereby, the blocked portion of the temporary opening 10 can be produced with further improved precision.

All the shapes and combinations of the constituent members shown in the aforementioned embodiment are one example, and additions, omissions, substitutions, and other modifications of the constitution are possible without departing from the spirit of the present disclosure. The present disclosure is not limited by the above description, but is only limited by the appended claims.

For example, in the aforementioned embodiment, even though the metal plates 18*a* and 18*b* are previously bonded to the inside surfaces of the precast concrete slabs 17*a* and 17*b*, metal plates may be omitted. In this case, it is preferable that the reinforcing bars be continuously disposed, in the temporary opening 10, vertically and horizontally.

Also, instead of embedding the pipes 11 in the bottom 3*a*, cutout grooves may be formed in the lower end of the precast concrete slab 17*b*, and ready-mixed concrete may be fed into the temporary opening 10 from the cutout grooves of the lower end of the precast concrete slab 17*b*.

In addition, in the aforementioned embodiment, the storage tank construction method of the present disclosure has been described as being applied to the method of constructing the low-temperature tank 1, but the present disclosure is not limited thereto. For example, the present disclosure can also be applied to a method of constructing a silo acting as a storage tank.

INDUSTRIAL APPLICABILITY

The present disclosure can provide a storage tank construction method capable of shortening the construction period by facilitating the process of blocking the temporary opening and further improving precision by facilitating control over the precision.

REFERENCE SIGNS LIST

1: low-temperature tank (storage tank)
3: outer tank
3*a*: bottom
3*b*: side wall
10: temporary opening
17*a*, 17*b*: precast concrete slab
18*a*, 18*b*: metal plate
25: separator
26: ready-mixed concrete (concrete)

The invention claimed is:

1. A storage tank construction method comprising:

a step of forming a side wall while a temporary opening is provided;

a step of fitting precast concrete slabs into respective inner and outer wall sides of the temporary opening to close the inner and outer wall sides of the temporary opening, each of the precast concrete slabs including a first surface and a second surface opposite to the first surface, and the first surfaces of the precast concrete slabs facing each other when the precast concrete slabs are fit into the respective inner and outer wall sides of the temporary opening; and a step of pouring concrete between the precast concrete slabs using the precast concrete slabs as molds to block the temporary opening, wherein metal plates are previously bonded to the first surfaces of the precast concrete slabs, wherein a first connecting fitting which is configured to be connected to a side-wall connecting fitting embedded in the side wall is embedded in the precast concrete slab fit into the inner wall side of the temporary opening so that the first connecting fitting is exposed to the first surface of the precast concrete slab fit into the inner wall side of the temporary opening, wherein a shape of the metal plate, which is bonded to the first surface of the precast concrete slab fit into the inner wall side of the temporary opening, has a shape that avoids a position at which the first connecting fitting is embedded in the precast concrete slab, and wherein a second connecting fitting which is configured to be connected to a side-wall connecting fitting embedded in the side wall is embedded in the precast concrete slab fit into the outer wall side of the temporary opening so that the second connecting fitting is exposed to the second surface of the precast concrete slab fit into the outer wall side of the temporary opening.

2. The storage tank construction method according to claim 1, wherein, after the precast concrete slabs are fitted into the respective inner and outer wall sides of the temporary opening, a separator is mounted between the precast concrete slabs to maintain a constant interval between the precast concrete slabs, and then the concrete is poured between the precast concrete slabs.

3. The storage tank construction method according to claim 1, wherein cutout grooves are formed in an upper end of the precast concrete slab fit into the outer wall side of the temporary opening, and in an upper end of the metal plate which is bonded to the first surface of the precast concrete slab fit into the outer wall side of the temporary opening.

4. The storage tank construction method according to claim 2, wherein:

a nut configured to be screwed to one end side of the separator is embedded in a center of the first surface of the precast concrete slab fit into the inner wall side of the temporary opening such that the nut is exposed to the first surface of the precast concrete slab fit into the inner wall side of the temporary opening, and a through-hole configured to communicate with the nut is formed in a center of the metal plate which is bonded to the first surface of the precast concrete slab fit into the inner wall side of the temporary opening; and through-holes for inserting the separator are formed in a center of the precast concrete slab fit into the outer wall side of the temporary opening, and in a center of the metal plate which is bonded to the first surface of the precast concrete slab fit into the outer wall side of the temporary opening.

* * * * *